US005606998A

United States Patent [19]

Wahhoud et al.

[11] Patent Number: 5,606,998

[45] Date of Patent: Mar. 4, 1997

[54] WEFT DETECTING AND STRETCHING APPARATUS IN A JET WEAVING LOOM

[75] Inventors: Adnan Wahhoud, Lindau-Bodolz; Hans-Dieter Scorl, Lindau; Valentin Krumm, Hergensweiler; Ulrich Loehr, Weissenberg, all of Germany

[73] Assignee: Lindauer Dornier Gesellschaft mbH, Lindau, Germany

[21] Appl. No.: 567,694

[22] Filed: Dec. 5, 1995

[30] Foreign Application Priority Data

Dec. 6, 1994 [DE] Germany ..... 44 43 371.9

[51] Int. Cl.[6] ..... D03D 47/30; D03D 51/34

[52] U.S. Cl. ..... 139/194; 139/370.2

[58] Field of Search ..... 139/194, 370.2, 139/435.1

[56] References Cited

U.S. PATENT DOCUMENTS

| | | | |
|---|---|---|---|
| 3,744,533 | 7/1973 | Yano et al. | 139/194 |
| 4,096,889 | 6/1978 | Larmit | 139/435 |
| 4,465,110 | 8/1984 | Dekker | 139/370.2 |
| 4,962,794 | 10/1990 | White | 139/370.2 |
| 5,226,458 | 7/1993 | Bamelis . | |

FOREIGN PATENT DOCUMENTS

| | | |
|---|---|---|
| 0108183 | 5/1984 | European Pat. Off. . |
| 2494731 | 5/1982 | France . |
| 3200637 | 8/1982 | Germany . |
| 682244 | 8/1993 | Switzerland . |
| 2119819 | 11/1983 | United Kingdom . |

*Primary Examiner*—Andy Falik
*Attorney, Agent, or Firm*—W. G. Fasse; W. F. Fasse

[57] ABSTRACT

A weft guide channel (6) in a reed of an air jet loom can be lengthened or shortened by telescoping sections forming one or two channel extension members (10, 18) and/or by intermediate inserts (21, 22, 23) that also have a weft guide channel portion (21A, 22A, 23A). The extension member (10) and the inserts are mounted to a mounting bracket (9) which itself is secured to the reed and/or the sley carrying the reed. At least one weft stop motion device is provided for each extension member and/or for the respective insert. One of the extension members is provided with air ducts (14, 15) for a crosswise air flow for stretching a weft thread.

20 Claims, 2 Drawing Sheets

WEFT DETECTING AND STRETCHING APPARATUS IN A JET WEAVING LOOM

FIELD OF THE INVENTION

The invention relates to an apparatus for stretching and/or detecting a weft thread in an air weaving loom. Such an apparatus is arranged downstream of the weft thread insertion or guide channel passing through the reed of the air jet loom, as viewed in the feed advance direction of the weft thread. More specifically, the apparatus is positioned downstream of a first weft stop motion device at the exit end of the weft insertion channel.

BACKGROUND INFORMATION

German Patent (DE-PS) 3,200,637 C2 (Dekker), published on Aug. 12, 1982, discloses an air jet loom equipped with a weft thread tensioning and detecting device that is arranged downstream of the first weft stop motion device that is integrated into the reed in the area of the weft thread exit of the reed.

The mechanism of the just mentioned German Patent includes a weft stretcher (9) that is effective in a direction cross-wise to the weft insertion direction for stretching the weft thread and keeping the weft thread taut. For this purpose, the weft stretcher which tensions the weft thread establishes an auxiliary airstream that deflects the leading end of an inserted weft thread protruding from the reed perpendicularly to the initial weft insertion direction, whereby the deflected leading weft end extends in a direction cross-wise to the main insertion direction. A first weft stop motion device (8) is positioned near the exit end of the weft insertion channel in the reed. A second weft stop motion device (15) is integrated into a weft guide member superimposed on the weft stretcher (9). The second weft stop motion device (15) provides a signal to the loom control if the inserted weft thread exceeds its rated length by a predetermined value as may be the case when a weft thread breaks. However, in order to prevent that an excess of the rated length of the weft thread causes the second weft stop motion device to generate a fault signal even though no weft break is present, and the exceeding of the rated length is merely due to an excess stretching response of the weft thread during the weft thread insertion operation, the spacing between the second weft stop motion device (15) and the stretcher (9) can be selected large enough so that such a weft thread that is temporarily stretched cannot reach the second weft stop motion device. However, the device disclosed in DE-PS 3,200,631 C2 is not suitable due to its structure, to detect a weft thread break of weft threads which are not to be stretched as is the case, for example for a portion of the weft threads used in weaving certain fabrics, wherein some weft threads are stretched and some are not to be stretched.

U.S. Pat. No. 5,226,458 (Bamelis), issued on Jul. 13, 1993, discloses a device for stretching a weft thread in weaving machines. The device is positioned at the exit end of the weft insertion channel in the reed (2) and connected to a sley (1) just as the reed itself. The known stretching device has a weft thread entrance leading into a weft guide channel extension in the direction of the weft thread insertion motion, whereby the weft guide channel is positioned in a first plane of the device.

The weft stretching device comprises two air flow ports positioned opposite each other across the weft guide channel. Due to this arrangement the stretching airstream extends at an angle cross-wise to the weft insertion direction in the guide channel and flows into a second flow channel arranged in a second plane above the first mentioned plane, thereby forming a second weft guide channel. Corresponding weft stop motion devices positioned for cooperation with the two weft guide channels are not disclosed in the above mentioned U.S. patent. The just described conventional arrangement of the weft stretching or tensioning device has the disadvantage that it cannot accommodate the stretching characteristics of different types of weft threads since the device is not variable in its length in the direction of weft insertion. Thus, there is room for improvement.

OBJECTS OF THE INVENTION

In view of the above it is the aim of the invention to achieve the following objects singly or in combination:

to construct a weft stretching and/or detecting device in such a way that the intended lengthening of a weft thread is not erroneously detected as a weft thread break to thereby avoid an unintended stopping of the loom;

to permit the weaving of weft threads having different stretching or tensioning characteristics while avoiding unintended loom stoppings; and to position a weft stop motion device selectively in such a location that different stretching characteristics of weft threads can be taken into account.

SUMMARY OF THE INVENTION

The above objects have been achieved by mounting at least one weft guide channel extension member that forms an extension channel for the weft guide channel in the reed of an air jet loom, on a mounting bracket in such a way that the effective length of the extension channel may be increased or decreased, for example by a telescoping action or by one or more channel extending inserts also mounted to the mounting brackets in variable positions which permits mounting or locating the respective further weft stop motion device or devices in accordance with the increased or decreased length of the extension channel which is thus adaptable to the stretching characteristics of the weft threads.

In a preferred embodiment two weft guide channel extension members are arranged one above the other in such a way that one or both extension members can be selectively lengthened or shortened with a corresponding positioning of the respective weft stop motion devices.

Elongated holes in the mounting bracket and/or in the extension inserts and/or in the weft stop motion devices permit locating the inserts and/or weft stop motion devices in properly adjusted positions relative to the length of the respective extension channel.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 2:
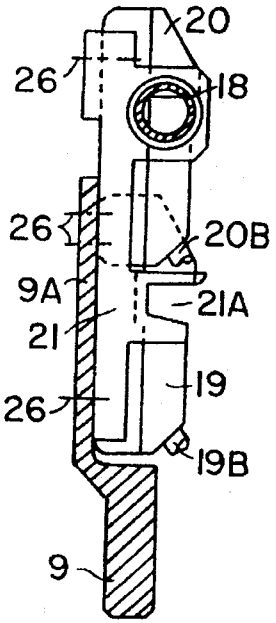
FIG. 2 is a sectional view along section line II—II in FIG. 1.
Figure 1:
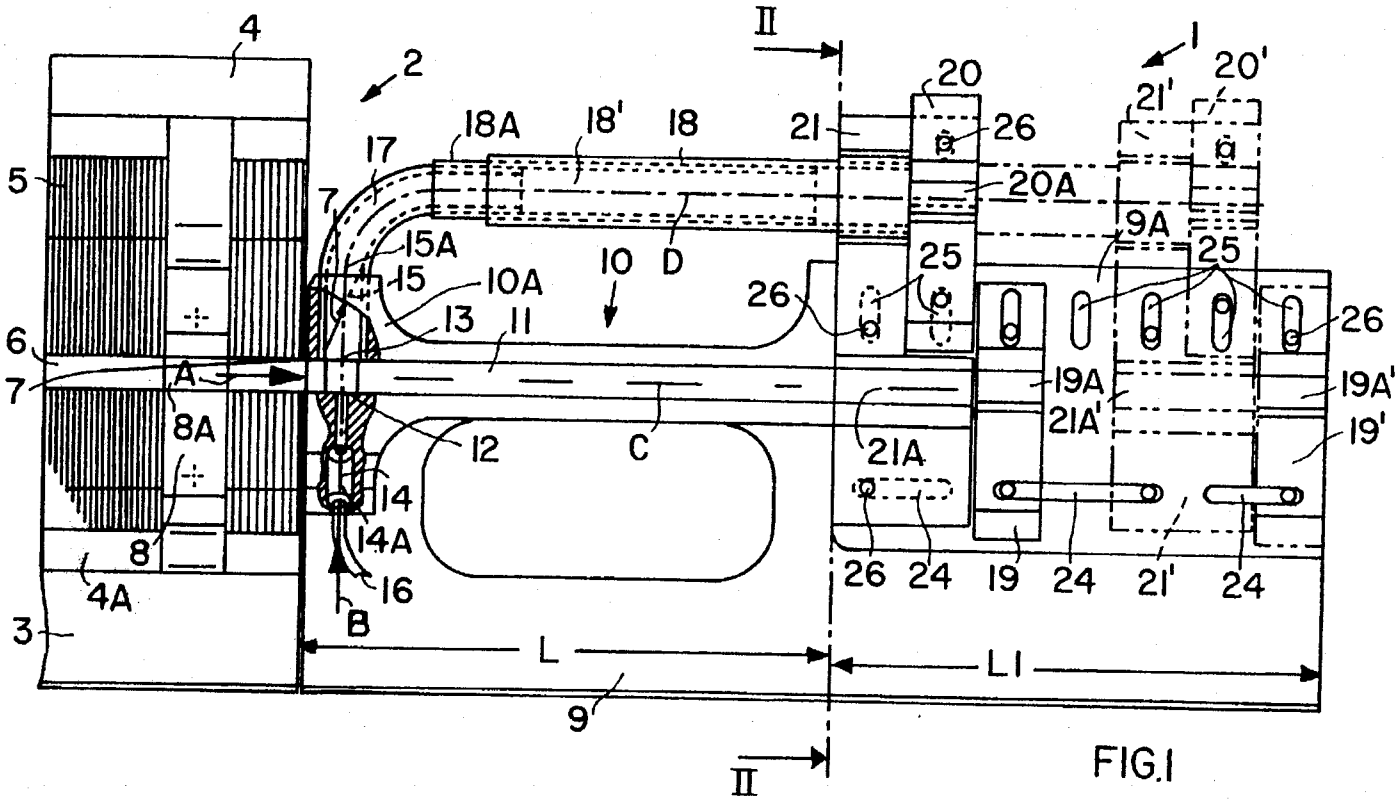
FIG. 1 shows a front view, partly in section, of a first embodiment according to the invention including an extension channel and a weft thread stretching device with respective weft stop motion devices, whereby two weft guide channel extension members, both of which are extendable, are mounted on a common bracket for securing the extension members to the reed or sley of the loom.

FIGS. 1 and 2 show a first structural component 1 embodying the invention with first and second weft guide channel extension members 10 and 18 to be described in more detail below. The members 10 and 18 are secured to a mounting bracket 9 which in turn is secured to a reed 2 and/or a sley 3 carrying the reed 2. The reed 2 comprises conventional reed frame members such as rails 4 and 4A holding reed teeth or dents 5 forming a weft thread insertion channel 6. The lower frame member 4A is secured to the conventional sley 3. A weft thread 7 travels through the channel 6 in the direction of the arrow A, thereby passing through a first weft stop motion device 8.

The first weft stop motion device 8 is integrated into the weft exit end of the reed 2. The device 8 has a channel portion 8A that is axially aligned with the channel 6. The weft stop motion device 8 is an opto-electronic sensor, the configuration of which is adapted to the reed teeth 5 to form the channel section 8A. The first weft stop motion device 8 monitors whether an inserted weft thread 7 has reached its rated length so that it is not too short for the next following beat-up motion of the sley 3 and reed 2. When the inserted weft thread 7 is too short, it does not reach the first weft stop motion device 8 which then generates a respective signal that is transmitted to the main loom control for stopping the loom.

The structural component 1 according to the invention is so mounted with its bracket 9 to the reed and/or sley that a first extension channel 11 formed by the first channel extension member 10 is axially aligned with the weft guide channel 6 in reed 2, in the direction of the arrow A in a first plane C of the component 1. Thus, the extension channel 11 lengthens the weft guide channel 6. The channel extension member 10 has an entrance section 10A shown partially in section to illustrate the formation of a weft stretcher formed by air ducts 14 and 15 and air flow openings 12 and 13. The air duct 14 is connected with its inlet 14A through an air hose 16 to a source of compressed air not shown. The air flows in the direction of the arrow B through the duct 14 to a flow nozzle or opening 12 that is positioned across the extension channel 11 opposite the air flow hole 13 leading into the air duct 15 which in turn is connected with its exit 15A to an air guide discharge duct 17 leading into the second channel extension member 18 forming a second extension channel 18'. The second extension member 18 is mounted to the bracket 9 in a second plane D, preferably in parallel to the first plane C of the first channel extension member 10. The channel extension member 18 has preferably several, at least two sections 18 and 18A telescoping relative to each other for varying the length of the extension channel 18'.

An auxiliary air flow indicated by the arrow B is formed across the main air flow through the extension channel 11 of the first channel member 10 for stretching the leading end of the weft thread 7, whereby the weft thread 7 is maintained under tension as long as the auxiliary air flow B is maintained.

According to the invention each of the channel extension member 10 and 18 is provided with its own weft stop motion device 19 and 20 respectively. The weft stop motion device 20 is mounted in a support 21 provided with a channel section 21A that lengthens the extension channel 11 of the extension member 10. For this purpose the support 21 is mounted by screws 26 passing through elongated holes 25 to a portion 9A of the mounting bracket 9 in such a position that the channel extension 21A axially aligns with the extension channel 11 in the first plane C. The weft stop motion device 20 is mounted by screws 26 to the support 21 in such a way that its sensor channel 20A aligns with the extension channel 18' of extension member 18 in the second plane D. By loosening the screws 26 and selecting the required holes 24 and 25, the support 21 may be shifted into the position 21' in which the weft stop motion device 20 also assumes the position 20'. Similarly, the weft stop motion device 19 is mounted to the bracket 9 with the help of elongated holes and screws so that the sensor channel 19A is aligned with the extension 21A in the full line position and also in the dashed line position 19' as shown at 19A' and 21A'. An electrical conductor 19B shown in FIG. 2 connects the signal generated by the sensor 19, to the central computer control. Similarly, an electrical conductor 20B connects the signal generated by the weft stop motion device 20, to the central computer control.

In FIGS. 1 and 2 the channel extension member 10 is preferably an integral part of the mounting bracket 9, 9A and the extension channel 11 forms an integral part of the member 10 which has a fixed extension length L. However, the added length L1 is adjustable between the full line positions of the elements 19, 20 and 21 and the respective dashed line position 19', 20', and 21' of these elements. Thus, it is possible to take the stretching characteristics of different weft threads 7 into account by adjusting the just mentioned elements within the length L1. The channel extension member 18 is so dimensioned with its sections 18 and 18A as to telescope between the full line and dashed line positions. As a result, the signals generated by the weft stop motion devices 19 and 20 and supplied on the electrical conductors 19B and 20B will be generated only in response to a true weft break, but will not be generated in response to a temporary stretching of a weft thread.

Figure 4:
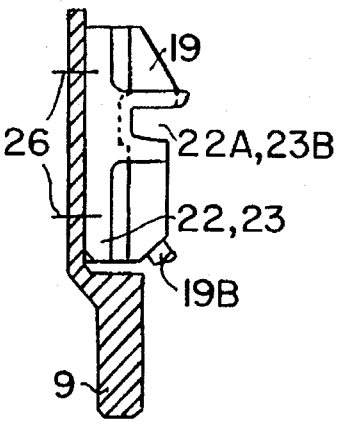
FIG. 4 is a sectional view along section line IV—IV in FIG. 3.
Figure 3:
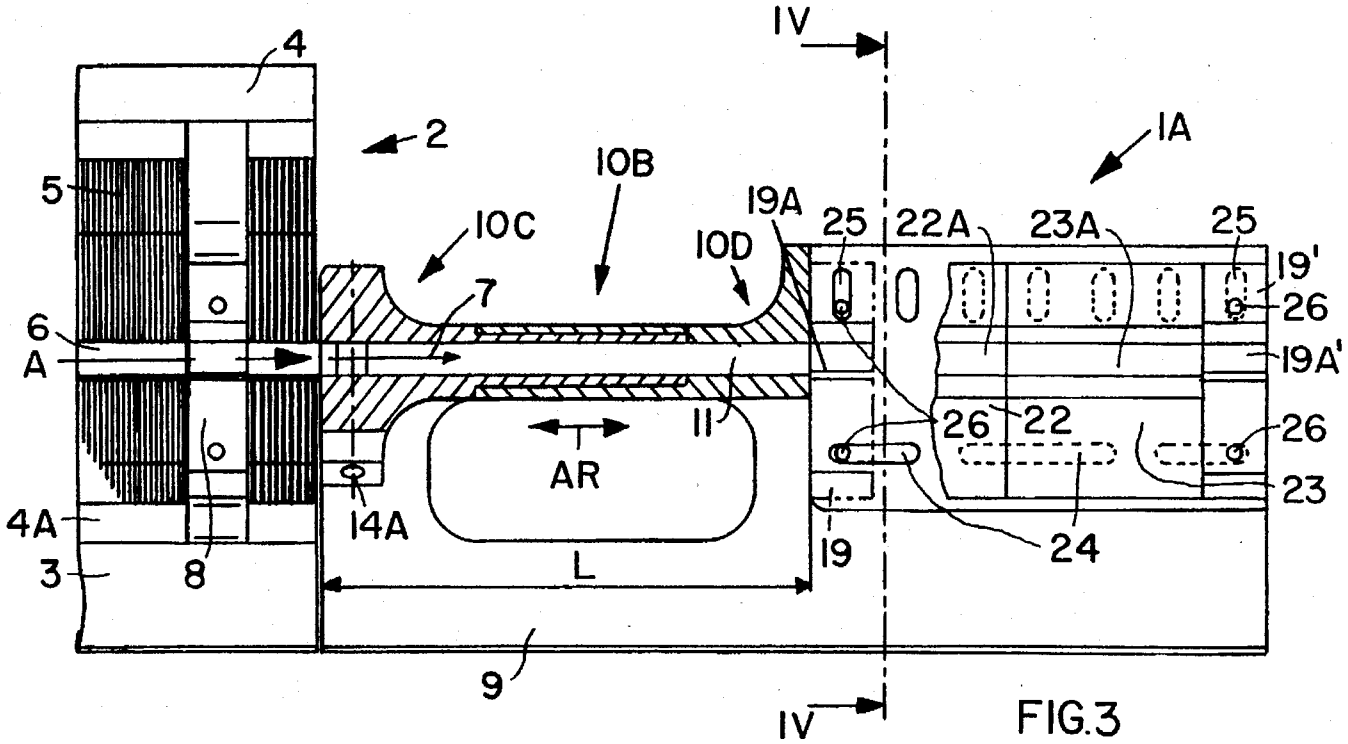
FIG. 3 shows a second embodiment with a view similar to that of FIG. 1, however illustrating a channel extension member with extension inserts for lengthening or shortening the extension channel and correspondingly locating the respective weft stop motion device.

The embodiment shown in FIGS. 3 and 4 does not include a weft stretcher. In this embodiment there are several possibilities of extending the basic length L of the channel extension member 10B which may either be an integral component with the mounting bracket 9 or it may have two sections 10C and 10D that telescope relative to each other as indicated by the double arrow AR. Additionally or instead, insert sections 22 and 23 having respective channel extensions 22A and 23A may be inserted between the exit end of the extension channel 11 and the entrance to the sensor channel 19A of the weft stop motion device 19 which thus may be shifted between the dashed line position 19 and the full line position 19'. The channel sections 19A, 22A, and 23A are aligned with each other, with the extension channel 11 and with the channel 6 so that the weft thread 7 with its leading end cannot be deflected out of the weft insertion direction A. All the channel sections 11, 19A, 22A and 23A have the same cross-sectional configuration relative to each other and relative to the weft insertion channel 6 of the reed 2.

The inserts 22 and 23 are mounted to the bracket 9 also with the aid of elongated holes 24, 25 and screws 26 as described above with reference to FIGS. 1 and 2. These connector elements 24, 25, 26 thus permit varying the effective channel length with the aid of the insert sections 22, 23.

The embodiment of FIGS. 3 and 4 is useful for weft threads that have a tendency to lengthen merely in response to the air flow that transports the weft threads through the insertion channel 6. For weft threads of this type a special stretcher may not be needed and a weft stop motion signal will not be generated by the weft stop motion device 19 in response to a temporary lengthening of the weft thread 7 unless there is an actual weft thread break.

Although the invention has been described with reference to specific example embodiments, it will be appreciated that it is intended to cover all modifications and equivalents within the scope of the appended claims.

What is claimed is:

1. An apparatus for detecting a weft thread travelling through a weft guide channel (6) in a reed of a jet weaving loom, comprising a weft guide channel extension member forming an extension channel (11) for said weft guide channel (6), wherein said channel extension member comprises extension elements for varying the channel length for weft threads having different stretching characteristics, a mounting bracket (9) for mounting said channel extension member so that said extension channel (11) is axially aligned with said weft guide channel (6), at least one weft stop motion device (19) for sensing a weft thread extending out of said extension channel (11), and connector elements (24, 25, 26) for securing said weft stop motion device (19) to said mounting bracket (9) in different positions in accordance with a varied length of said extension channel (11).

2. The apparatus of claim 1, wherein said extension channel (11) of said channel extension member comprises a channel configuration that is substantially identical to a configuration of said weft guide channels (6).

3. The apparatus of claim 2, wherein said configurations have an identical channel cross-section.

4. The apparatus of claim 1, wherein said channel extension elements comprise intermediate channel inserts (22, 23) for varying said variable length of said extension channel (11), each intermediate channel insert having a channel configuration (22A, 23A) that is substantially identical to that of said extension channel (11).

5. The apparatus of claim 1, wherein said channel extension elements of said weft guide channel extension member (10B) comprise a plurality of telescoping sections (10C, 10D) for varying said variable length.

6. The apparatus of claim 1, further comprising a second weft guide channel extension member (18) forming a second extension channel (18'), wherein said second channel extension member (18) comprises second channel extension elements for varying the length of said second channel extension member (18), and a second weft stop motion device (20) secured to said mounting bracket (9) by said connector elements (25, 26) in different positions in accordance with a varied length of said second extension channel (18').

7. The apparatus of claim 6, wherein said second channel extension elements of said second weft guide channel extension member (18) comprise telescoping sections (18, 18A) for varying said variable length of said second extension channel (18').

8. The apparatus of claim 6, further comprising a weft thread stretching channel section (15) connecting said first mentioned weft guide channel extension member (10) to said second weft guide channel extension member (18).

9. The apparatus of claim 8, further comprising a support for holding said second weft guide channel extension member (18) in parallel to said first mentioned weft guide channel extension member (10).

10. The apparatus of claim 6, wherein one of said first mentioned weft guide channel extension member (10) and said second weft guide channel extension member (18) comprises as said extension elements telescoping sections for varying said variable length of the respective channel extension channel, and wherein the other of said first mentioned weft guide channel extension member and said second weft guide channel extension member comprises as said second extension elements intermediate channel inserts (22, 23) with channel sections (22A, 23A) for varying said variable length of the respective extension channel (11, 18').

11. The apparatus of claim 10, wherein said intermediate channel inserts (22, 23) have a channel configuration that is substantially identical to a configuration of said weft guide channel (6).

12. The apparatus of claim 11, wherein said configurations have an identical channel cross-section.

13. The apparatus of claim 10, wherein said first mentioned weft guide channel extension member (11) is extendable by said intermediate channel inserts (22, 23), and wherein said second channel extension member (18) is extendable by said telescoping sections (18, 18A).

14. The apparatus of claim 1, wherein skid mounting bracket (9) is adapted to be secured to one of said reed (2) and a sley (3) of said jet weaving loom.

15. An apparatus for detecting a weft thread travelling through a weft guide channel (6) in a reed of a jet weaving loom, comprising a first weft guide channel extension member (10) forming a first extension channel (11) for said weft guide channel (6), a mounting bracket (9) for mounting said first channel extension member (10) so that said extension channel (11) is axially aligned with said weft guide channel (6), a first weft stop motion device (19) secured to said mounting bracket (9) for cooperation with said first extension channel (11), a second weft guide channel extension member (18) forming a second extension channel (18') also secured to said mounting bracket (9), a second weft stop motion device (20) supported on said mounting bracket (9) for cooperation with said second weft extension channel (18'), and a device for lengthening or shortening at least one of said first and second extension channels (11, 18').

16. The apparatus of claim 15, wherein said lengthening or shortening device comprises at least one weft guide channel extension element that has a length which differs from a length of said first and second weft guide channel extension members (10, 18), and wherein said at least one weft guide channel extension element has a configuration that is exchangeable for one of said first and second weft guide channel extension members.

17. The apparatus of claim 15, wherein said second weft guide channel extension member (18) has a variable length, wherein said lengthening or shortening device comprises a support (21) securable to said mounting bracket (9) in different positions for holding said second weft guide channel extension member (18) of different lengths, and wherein said support (21) comprises a channel section (21A) that lengthens said extension channel (11) of said first weft guide channel extension member (10).

18. The apparatus of claim 17, wherein said second weft guide channel extension member (18) comprises a plurality of telescoping sections (18, 18A).

19. The apparatus of claim 15, wherein said device for lengthening or shortening comprises elongated holes (24, 25) and screws (26) passing through said elongated holes and at least one insert (21, 22, 23) for lengthening or shortening at least one of said first and second weft guide channel extension members (10, 18), said screws securing said at least one insert to said mounting bracket (9), whereby said elongated holes permit locating said at least one insert (21, 22, 23) in different positions for lengthening the respective first and/or second extension channels (11, 18').

20. The apparatus of claim 15, further comprising air guide elements (14, 15) arranged in said first weft guide channel extension member (10) to pass crosswise through said first extension channel (11) in said first weft guide channel extension member (10) and into said second weft guide channel extension member (18) for stretching a weft thread (7).

* * * * *